United States Patent [19]

Allgaier et al.

[11] Patent Number: 4,650,344

[45] Date of Patent: Mar. 17, 1987

[54] RADIO CONTROLLED TIMEPIECE

[75] Inventors: Jürgen Allgaier, Lauterbach; Wolfgang Ganter, Schramberg, both of Fed. Rep. of Germany

[73] Assignee: Junghans Uhren GmbH, Schramberg, Fed. Rep. of Germany

[21] Appl. No.: 791,555

[22] Filed: Oct. 25, 1985

[30] Foreign Application Priority Data

Oct. 30, 1984 [DE] Fed. Rep. of Germany ..... 3439638

[51] Int. Cl.[4] ..... G04C 11/02

[52] U.S. Cl. ..... 368/47; 368/59; 368/202

[58] Field of Search ..... 368/47–60, 368/220, 221, 203, 204

[56] References Cited

U.S. PATENT DOCUMENTS

| | | | |
|---|---|---|---|
| 4,315,332 | 2/1982 | Sakami et al. | 368/47 |
| 4,316,274 | 2/1982 | Ushikoihi | 368/203 |
| 4,525,685 | 6/1985 | Hesselberth | 368/47 |
| 4,565,454 | 1/1986 | Walters | 368/47 |

FOREIGN PATENT DOCUMENTS 3015312 10/1981 Fed. Rep. of Germany .

OTHER PUBLICATIONS

Article, "Unren durch Funk gesteuert", VDI-Nachrichten, No. 3, Jan. 21, 1977 (with translation for pertinent portions).

H. Effenberger, "Mikroprozessorgesteuerte Funkuhr mit Analoganzeige," Viertes Darmstadter Kolloquim, pp. 104–109, 1983.

G. Krug, "Funkferngersteuerte Uhren", Uhren and Schmuck 8 (1971) 2, pp. 57–59.

*Primary Examiner*—Bernard Roskoski

*Attorney, Agent, or Firm*—Burns, Doane, Swecker & Mathis

[57] ABSTRACT

A radio controlled timepiece includes a radio receiver for demodulating a transmitted signal on which time and date information has been encoded. A pulse sequence is derived from the transmitted radio signal which is used to drive the stepping motor which advances the hands of a standard display timepiece. If unfavorable reception conditions exist, then the stepping motor will not be driven smoothly and the poor reception will be readily apparent from the irregular movement of the clock hand. A switch is provided to allow the stepping motor to be normally driven by a pulse sequence output of a standard time keeping circuit. A comparator compares the time displayed on the face of the timepiece with the time information encoded on the radio signal and, if the displayed time deviates from the actual time, the frequency of the pulse sequence from the time keeping circuit is adjusted to correct the displayed time.

12 Claims, 1 Drawing Figure

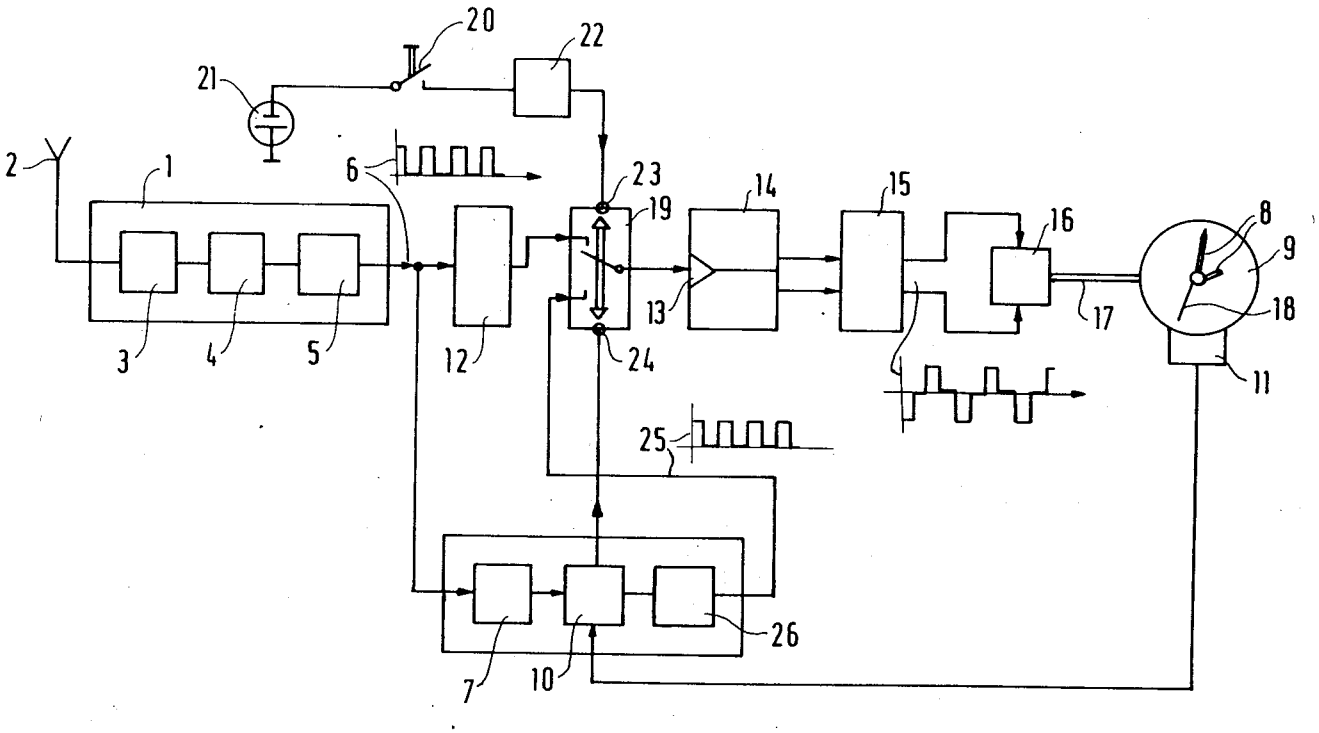
1
2
3
4
5
6
7
8
9
10
11
12
13
14
15
16
17
18
19
20
21
22
23
24
25
26

RADIO CONTROLLED TIMEPIECE

CROSS-REFERENCE TO RELATED APPLICATIONS

This invention is related to that described in copending U.S. application Ser. No. 789,157, filed Oct. 18, 1985 now U.S. Pat. No. 4,645,357 by Jurgen Allgaier and Wolfgang Ganter (corresponding to German Applications Ser. No. G 84 32 847.9 filed Nov. 9, 1984 and Ser. No. P 35 10 861.4-31 filed Mar. 26, 1985). The subject matter of the copending U.S. application is hereby incorporated by reference herein.

BACKGROUND OF THE INVENTION

The present invention relates to a radio signal controlled timepiece including a display for indicating the reception of a transmitted signal.

Devices of this type are shown, for example, in German Offenlegungsschrift No. 30 15 312 published Oct. 22, 1981. In the context of the present invention, a radio signal controlled timepiece combines a conventional timepiece having an electronic time keeping circuit with a radio receiver. The radio receiver receives a signal on which the actual time of day is coded. Periodically, the time displayed by the timepiece is compared with the transmitted time. If the displayed time deviates from the actual time, appropriate steps are taken to correct the time displayed on the timepiece.

Particularly when the radio signal controlled timepiece is designed as a consumer item, interference or blocking of the radio signal may result from the positioning of the timepiece or from temporary environmental conditions. Temporary disturbances are not fatal to proper operation of the device, but typically merely cause the decoding of the actual time information and its comparison with the current time display to be delayed from a regularly scheduled point in time to a time when more favorable receiving conditions exist. However, when poor reception is attributable to nontemporary conditions, proper reception will not occur at a later time and correction of improperly set or inaccurate time information will not take place.

There is little practical utility to an everyday user of a consumer timepiece to perform an electronic comparison of inadequately received time decoding information against standard pulses and provide a digital display indicating the quality of the received signal. For example, coded information related to the signal quality could be displayed to indicate whether proper operation is occurring. Though such a digital evaluation of the receiving conditions might be of scientific interest, it provides no particular useful information to a typical daily user of a consumer timepiece.

Accordingly, it is an object of the present invention to provide a radio signal controlled timepiece having a standard time display including an hour hand and a minute hand, and which will generate an indication of the quality of the received coded time information that will be readily interpreted by an everyday user without the necessity of additional display means. More particularly, it is an object of the invention to provide a radio signal controlled timepiece which utilizes a standard clock display to indicate whether or not the coded time information is being properly received, and thus whether or not a correction of a possibly incorrect setting of the hands will occur.

SUMMARY OF THE INVENTION

These and other objects of the present invention are attained by driving a stepping motor which controls the advance of a time indicating hand with a signal derived from the demodulated radio signal on which the correct time information is coded. When poor reception conditions exist, the time indicating hand will be driven erratically and will inform the user of the poor conditions so that appropriate steps may be taken to correct the situation. Conversely, if the signal is received without interference, the hand advances in a rhythmic fashion to indicate proper reception.

Any effort to quantitatively evaluate the quality of the radio signal modulated by the coded time information is rendered unnecessary by the features of the present invention. Rather, when sufficient reception conditions are present, one of the clock hands, for example the second hand, is advanced in the usual rhythmic sequence by a pulse sequence obtained from the radio signal except that the fifty-ninth pulse is suppressed. This procedure provides a clear indication which is readily interpreted by even a layman that the timepiece is operating in a regular manner and that the time indicated on the face of the timepiece, if it deviates from the correct time, will be adjusted to indicate the correct time. Conversely, if there is interference affecting proper reception of the coded time information, the pulse sequence obtained from the radio signal will either be missing pulses or the pulses will appear in an irregular manner relative to the usual rhythmic sequence. These irregularities cause an unusual advance of the hand which deviates from the usual rhythmic advance of the hand to indicate that there is interference with proper reception. In extreme cases where no pulses are demodulated from the radio signal, there will be no movement of the hand.

In any case, an irregular movement of the second hand with respect to the usual seconds rhythm makes it obvious, even to the everyday user, that the time displayed might be incorrect and that it will not be corrected in the immediately foreseeable future. Hence, the user can attempt to improve reception conditions, for example by relocating the timepiece.

It is particularly advantageous to superpose the pulses from the demodulated radio signal onto the stepping movement of the clock hand being used to indicate reception quality only at the time that the timepiece is actuated and then to switch to an internal time keeping circuit once the first complete set of time information is decoded and made available for comparison and, if necessary, time display correction. If the demodulated pulses occur regularly in the seconds frequency and the seconds hand is selected as the reception indicator, the typical user will generally not even notice the switching of the stepping movement of the hand from the seconds sequence of the demodulated pulses to the seconds sequence of the time-keeping circuit. The only noticeable difference will be that when operating in response to the demodulated pulses the fifty-ninth pulse will be suppressed, whereas with the pulse sequence from the time-keeping circuit, the hand will be stepped through an entire sixty step cycle. This slight difference in operating characteristics permits the user to detect proper reception of the radio signal and proper operation of the decoding circuit, but prevents the user from being unduly irritated by this measure.

Alternatively, if a more obvious indication that the device is functioning properly is desired, it is more advantageous to select as the indicator hand one that is not normally stepped in a seconds rhythm. That is, the minute or hour hand of the timepiece, driven by a separate motor could be employed as the reception indicator.

The switching of the drive signal to the hand stepping motor from the demodulated pulses to the pulses from the time-keeping circuit can be effected advantageously, particularly when the displayed time is determined and corrected by means of a microprocessor, by a circuit connected with decoding circuitry for the radio signal and a comparator for the time information coded onto the received radio signal.

BRIEF DESCRIPTION OF THE DRAWING

The features and advantages of the present invention, as well as further alternatives and additional developments, will become apparent from the following detailed description of the preferred embodiment, when read in light of the accompanying drawing in which one embodiment of the present invention is schematically illustrated in block diagram form.

DETAILED DESCRIPTION OF THE PREFERRED EMBODIMENT

Referring to the drawing, the radio signal controlled timepiece includes a radio receiver 1 having a high frequency element 3, a demodulator 4, and an output amplifier 5 connected in series. A radio signal received by an antenna 2, for example an iron core coil, is input into the radio receiver 1 which produces a pulse sequence or rectangular-wave signal 6 having a frequency of 1 Hz and having complete time and date information coded onto it by means of pulse length coding (not shown in the drawing). Proper coding of the time and date information requires roughly 60 cycles, or one minute, of the rectangular-wave signal 6.

If an undisturbed signal 6 has been received over a period of at least one full minute, information concerning the instantaneous point in time may be detected therefrom by a decoding circuit 7. The time currently displayed on the face 9 of the timepiece by the hands 8 is detected by a hands position indicator 11 such as a rotational angle meter or an incremental step transducer. An appropriate position detector is disclosed in the related copending U.S. application Ser. No. 789,157 noted earlier. The correct time from the decoding circuit 7 is then compared against the displayed time by a comparator 10.

The pulse sequence 6 passes through a threshold stage 12 and actuates, for example by the rising edge of the individual pulses, the dynamic switching input 13 of a bistable pole-reversing circuit 14. The bistable pole-reversing circuit 14 has a pair of mutually inverted outputs which, due to the operation of the dynamic switching input 13, produce an alternating sequence of pulses having opposite polarities. In some cases, it may be necessary to amplify the pulse sequences on the outputs of the bistable pole-reversing circuit 14. For this purpose the outputs are connected to an amplifier 15 which amplifies the signals on each of the individual output lines from the bistable pole-reversing circuit 14. The output lines may also be part of a pole reversing bridge circuit.

The drive coil of a bipolar single phase clock stepping motor 16 is connected across the output lines of the bistable circuit 14, or the amplifier 15. As noted earlier, the outputs of the pole-reversing circuit are mutually inverted and thus the pulse sequence on one of the output lines is 180 degrees out of phase with respect to the pulse sequence on the other output line. Hence, the rotor of the bipolar single phase stepping motor 16 is driven through one-half of a complete rotation by each pulse in the pulse sequence. A drive gear 17 links the rotor of the motor 16 the indicating hand, which in this case is the seconds hand 18, and drives the indicating hand through a distance representing a single unit on the clock face 9 for each half rotation of the rotor. Hence, if the pulse sequence from the radio receiver 1 is undisturbed, the indicating hand will be driven at the proper frequency in incremental steps, each step representing one second. Thus, when the seconds hand 18 is used as the reception indicator, the hand will advance in the usual manner when good reception conditions exist.

If, however, there is interference affecting the pulse sequence 6 causing missing or interrupted individual pulses, the hand will not advance in the usual uniform stepping motion of one second angular steps, but rather will advance, for example, by irregular jumps. The irregular movement of the indicator hand provides the user with an immediately apparent indication that poor receiving conditions exist.

Preferably a switching device 19 is provided to selectively connect one of two pulse sources to the dynamic switching input 13 of the bistable circuit 14 in order to drive the stepping motor 16. The switching device 19 has a first position in which, as described above, the pulse sequence 6 from the radio receiver 1 is input to the bistable circuit 14. In a second position, the switching device 19 connects the bistable circuit 14 to a time-keeping circuit 26 which generates a pulse sequence 25 set at the clock frequency.

The switching device 19 is placed in the first position when the clock is initially actuated after an idle period, for example by an operating switch 20 or insertion of a power source such as a battery 21. In this manner, or optionally by a setting pulse from a trigger circuit 22, a set input to the switching device 19 is actuated to place the switch in the first position whereby the pulse sequence 6 is supplied to the bistable pole-reversing circuit 14. Consequently, when the timepiece is first turned on, the progress of the indicator hand 18 will advance in a regular manner only if an undisturbed pulse sequence 6 is being received.

Once the decoding circuit 7 has decoded the time information from the pulse sequence 6, the comparator 10 performs the comparison between the actual time and the time indicated on the face of the timepiece. The comparator 10 then generates a reset pulse to the reset input 24 of the switching device 19 whereby time keeping pulses 25 from the time keeping circuit 26 are supplied to the pole-reversing circuit 14 until the operation of the timepiece is interrupted again. Thus, the seconds hand 18 is normally advanced in the usual stepping motion at the correct angular speed. However, if the comparator 10 detects a deviation between the displayed time and the actual time, the time keeping device 26 can temporarily adjust the frequency of the pulse sequence 25 to correct the deviation.

It may be desirable to provide separately driven stepping motors for the seconds hand 18 and for the minute and hour hands 8, and to actuate them separately from the comparator 10. In this way, it is possible to make rapid adjustments to the position of the hands 8 without the necessity of driving the seconds hand 18, and thus the drive gear 17, at an inappropriate velocity. Separate stepping motors would also make it possible to use the minute hand or even the hour hand as the reception indicating hand, in which case the switching device 19 would selectively connect the stepping motor which drives the indicator hand to either the rectangular-wave signal 6 or the time keeping pulse sequence 25.

The principles, preferred embodiments and modes of operation of the present invention have been described in the foregoing specification. The invention which is intended to be protected herein, however, is not to be construed as being limited to the particular forms disclosed, since these are to be regarded as illustrative rather than restrictive. Variations and changes may be made by those skilled in the art without departing from the spirit of the invention.

What is claimed is:

1. A radio signal controlled timepiece, comprising:

at least one time indication hand, the position of said at least one hand providing a representation of the time of day;

stepping motor means for driving said at least one time indication hand; and radio receiver means for demodulating a radio signal to provide a pulse sequence, said pulse sequence having missing or interrupted individual pulses when poor reception conditions exist, said pulse sequence operating said stepping motor means such that the motion of one of said at least one time indication hand provides an indication of the quality of the received radio signal.

2. The apparatus of claim 1, further comprising:

time keeping means for generating a time keeping pulse sequence; and switching means for selectively connecting said stepping motor means to said radio signal pulse sequence or to said time keeping pulse sequence.

3. The apparatus of claim 2, wherein said one of said at least one time indication hand is a seconds hand.

4. The apparatus of claim 2, wherein said radio signal pulse sequence includes coded time information and further including a decoding circuit for decoding said time information, said switching means initially set in a first position to drive said stepping motor means with said radio signal pulse sequence, said decoding circuit generating a reset signal after said time information is decoded to set said switching means in a second position to drive said stepping motor means with said time keeping pulse sequence.

5. The apparatus of claim 4, wherein said one of said at least one time indication hand is a seconds hand.

6. The apparatus of claim 4, further including means for detecting the time of day indicated by said time indication hand; and comparator means for comparing the time detected by said detecting means with the time information decoded by said decoding means, said comparator means providing a signal to said time keeping means, said time keeping means operable to vary the frequency of said time keeping pulse sequence to correct the time indicated by said time indication hand.

7. The apparatus of claim 6, further including a bistable pole-reversing circuit having first and second outputs, wherein said stepping motor means is connected across said first and second outputs, said bistable circuit receiving the pulse sequence from said switching means and supplying first and second alternating sequence of opposite polarity pulses on said first and second outputs, respectively, said first alternating sequence 180 degrees out of phase with respect to said second alternating sequence.

8. The apparatus of claim 7, wherein said one of said at least one time indication hand is a seconds hand.

9. The apparatus of claim 4, further including a bistable pole-reversing circuit having first and second outputs, wherein said stepping motor means is connected across said first and second outputs, said bistable circuit receiving the pulse sequence from said switching means and supplying first and second alternating sequence of opposite polarity pulses on said first and second outputs, respectively, said first alternating sequence 180 degrees out of phase with respect to said second alternating sequence.

10. The apparatus of claim 9, wherein said one of said at least one time indication hand is a seconds hand.

11. The apparatus of claim 2, further including a bistable pole-reversing circuit having first and second outputs, wherein said stepping motor means is connected across said first and second outputs, said bistable circuit receiving the pulse sequence from said switching means and supplying first and second alternating sequence of opposite polarity pulses on said first and second outputs, respectively, said first alternating sequence 180 degrees out of phase with respect to said second alternating sequence.

12. The apparatus of claim 11, wherein said one of said at least one time indication hand is a seconds hand.

* * * * *